US007726770B2

(12) United States Patent
Mizutani et al.

(10) Patent No.: US 7,726,770 B2
(45) Date of Patent: Jun. 1, 2010

(54) INKJET PRINTER

(75) Inventors: Shunsuke Mizutani, Nagoya (JP); Jun Morikawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 743 days.

(21) Appl. No.: 11/554,968

(22) Filed: Oct. 31, 2006

(65) Prior Publication Data

US 2007/0097169 A1 May 3, 2007

(30) Foreign Application Priority Data

Oct. 31, 2005 (JP) ..... 2005-317565

(51) Int. Cl.
*B41J 2/165* (2006.01)

(52) U.S. Cl. ..... 347/23; 347/29; 347/30; 347/33; 347/35

(58) Field of Classification Search ..... 347/22, 347/23, 24, 29, 30, 33, 35
See application file for complete search history.

(56) References Cited

U.S. PATENT DOCUMENTS 5,379,061 A * 1/1995 Yamaguchi et al. ..... 347/23
6,286,928 B1 * 9/2001 Kasamatsu ..... 347/23
6,293,645 B1 * 9/2001 Kim ..... 347/23
6,386,677 B1 5/2002 Imai et al.

FOREIGN PATENT DOCUMENTS

EP 0799701 A1 4/1997
JP H10-006528 A 1/1998
JP H11-078068 A 3/1999

* cited by examiner

*Primary Examiner*—Shih-wen Hsieh
(74) *Attorney, Agent, or Firm*—Baker Botts L.L.P.

(57) ABSTRACT

An inkjet printer includes: a print head; a maintaining unit; a timing unit; a notifying unit; a maintenance command determining unit; and a maintenance operation executing unit. The print head is formed with one or more ink ejection opening for printing a printing medium by ejecting ink through the ink ejection opening. The maintaining unit restores the ink ejection state of the print head by flowing ink through the ink ejection opening. The timing unit keeps track of an elapsed time after the maintaining unit has executed a maintenance operation. The notifying unit notifies a user when it is time to execute a maintenance operation if the elapsed time measured by the timing unit exceeds a prescribed time. The maintenance command determining unit determines whether or not the user has issued a command to execute a maintenance operation with the maintaining unit after the notifying unit has issued a notification. The maintenance operation executing unit executes a maintenance operation with the maintaining unit when the maintenance command determining unit determines that the user has issued a command to execute the maintenance operation.

9 Claims, 4 Drawing Sheets

FIG.4 (PROCESS PERFORMED ON THE MULTIFUNCTION PERIPHERAL DEVICE)
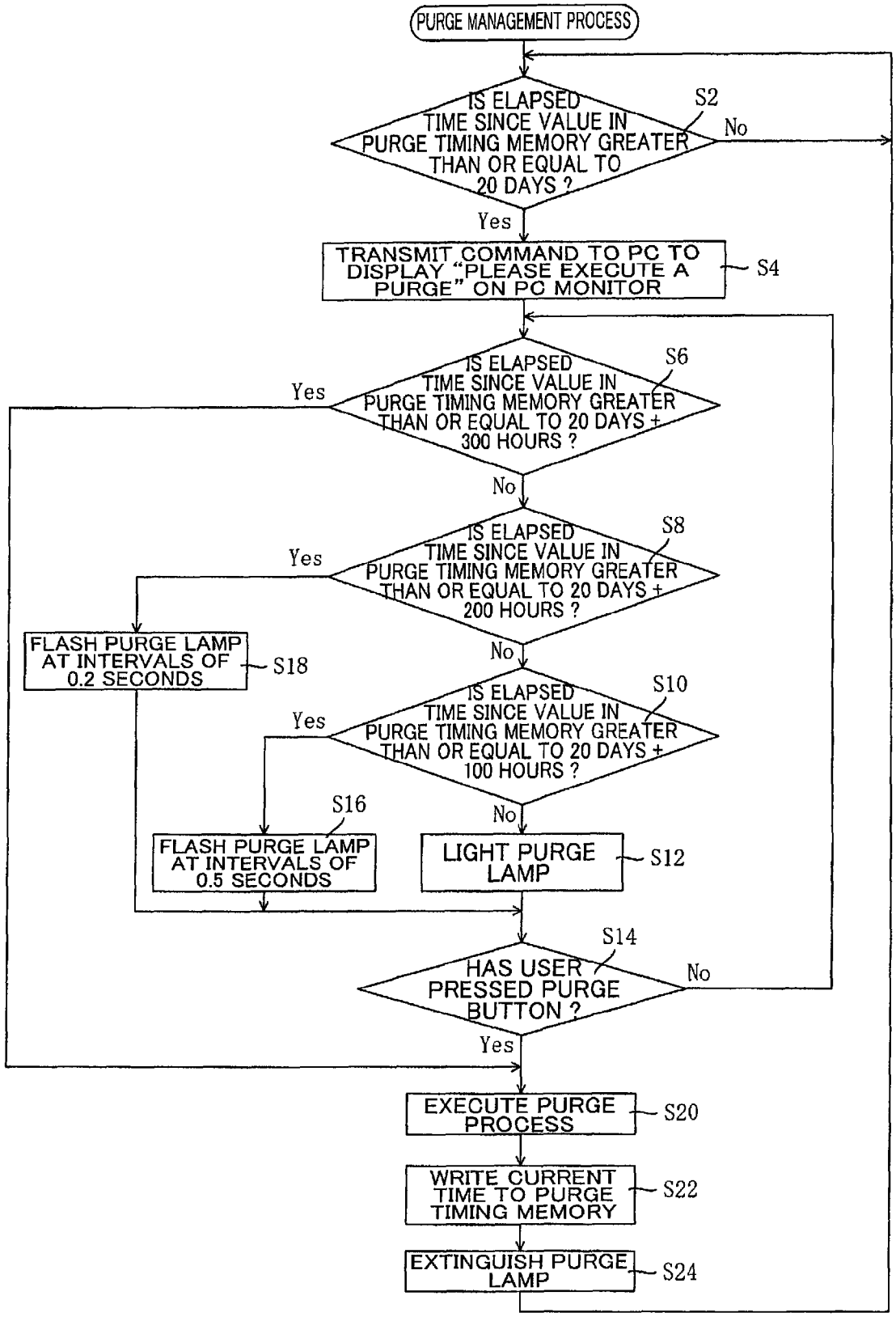

INKJET PRINTER

CROSS REFERENCE TO RELATED APPLICATION

This application claims priority from Japanese Patent Application No. 2005-317565 filed Oct. 31, 2005, the entire content of which is incorporated herein by reference.

TECHNICAL FIELD

The disclosure relates to an inkjet printer, and particularly to an inkjet printer capable of suppressing printing operations performed with a degree of printing complications that are unacceptable to the user by executing a maintenance operation at a suitable timing, while suppressing unnecessary ink consumption.

BACKGROUND

Conventional inkjet printers print on recording paper by ejecting ink from a print head having a plurality of ink ejection openings or nozzles formed therein. In this inkjet printer, ink ejection problems can occur when air bubbles are generated in the ink while the print head is in use, when ink or microparticles of foreign matter are deposited on the surface of the ink ejection openings, and the like. Further, if the printer is left unused for a long period of time, the ink ejection openings may become clogged with ink, leading to ink ejection problems. Since printing quality suffers if a printing operation is performed while ink ejection is problematic, a purge process is generally performed to restore the ink ejection openings to a good ejection state. The purge process is performed, for example, by generating a negative pressure with a pump to draw ink out of the print head after hermetically sealing the print head with a suction cap, or performing a preliminary ejection process to eject ink from the nozzles.

Since the user executes this purge process manually after detecting printing problems, printing complications occur once at the very least. In order to overcome this problem, an inkjet printer such as that disclosed in U.S. Pat. No. 6,386,677B1 has been proposed to execute a purge process automatically when conditions indicating the potential for printing problems have been met. In this inkjet printer, if conditions indicating the potential for printing complications are met, for example, if a prescribed time or more has elapsed since the previous purge process, the inkjet printer executes a purge process before such printing problems can occur, thereby preventing the occurrence of printing complications.

SUMMARY

However, there are diverse applications for an inkjet printer, and printing complications are allowable in many of these applications. It can be beneficial not to perform purge processes when possible if the user determines that printing complications are allowable because frequent purge processes lead to an unnecessary consumption of ink that could otherwise be used for printing. The inkjet printer described above automatically executes a purge process regardless of whether printing complications are acceptable to the user, leading to ink consumption not desired by the user.

This problem is particularly apparent in inkjet printers having a facsimile function. Since the power to inkjet printers having a facsimile function is often left on continuously so that the printer can receive facsimile data at any time, the purge process is inevitably performed a very large number of times since the process is executed automatically at prescribed time intervals. As a result, the user may become distrustful of the inkjet printer since the ink is gradually consumed without the user knowing, regardless of whether the user is using the printer.

Further, while frequent execution of purge processes can lead to an unnecessary consumption of ink, infrequent execution of purge processes may lead to the solidification of ink deposited on the surface of the ink ejection openings to the extent that ink ejection cannot be restored even through a purge process. Continuing to use the printer in such a state may also cause damage t the print head.

In view of the foregoing, it is an object of the invention to provide an inkjet printer capable of reducing the amount of printing performed with printing complications that are unacceptable to the user and capable of suppressing unintended ink consumption by performing a maintenance operation at a suitable timing.

In order to attain the above and other objects, the invention provides an inkjet printer including: a print head; a maintaining unit; a timing unit; a notifying unit; a maintenance command determining unit; and a maintenance operation executing unit. The print head is formed with one or more ink ejection opening for printing a printing medium by ejecting ink through the ink ejection opening. The maintaining unit restores the ink ejection state of the print head by flowing ink through the ink ejection opening. The timing unit keeps track of an elapsed time after the maintaining unit has executed a maintenance operation. The notifying unit notifies a user when it is time to execute a maintenance operation if the elapsed time measured by the timing unit exceeds a prescribed time. The maintenance command determining unit determines whether or not the user has issued a command to execute a maintenance operation with the maintaining unit after the notifying unit has issued a notification. The maintenance operation executing unit executes a maintenance operation with the maintaining unit when the maintenance command determining unit determines that the user has issued a command to execute the maintenance operation.

According to another aspect, the invention provides an inkjet printer including: a print head; a maintaining unit; a timing unit; a notifying unit; a maintenance command determining unit; and a maintenance operation executing unit. The print head is formed with one or more ink ejection opening for printing a printing medium by ejecting ink through the ink ejection opening. The maintaining unit restores the ink ejection state of the print head by ejecting or drawing ink from the ink ejection opening. The timing unit keeps track of an elapsed time after the maintaining unit has executed a maintenance operation. The notifying unit notifies a user when it is time to execute a maintenance operation if the elapsed time measured by the timing unit exceeds a prescribed time. The maintenance command determining unit determines whether or not the user has issued a command to execute a maintenance operation with the maintaining unit after the notifying unit has issued a notification. The maintenance operation executing unit executes a maintenance operation with the maintaining unit when the maintenance command determining unit determines that the user has issued a command to execute the maintenance operation.

According to another aspect, the invention provides a method of maintaining an ink ejection state of a print head in an inkjet printer, the inkjet printer including the print head formed with one or more ink ejection opening for printing a printing medium by ejecting ink through the ink ejection opening, a maintaining unit that restores the ink ejection state of the print head by flowing ink through the ink ejection opening. The method includes: keeping track of an elapsed time after a maintaining unit has executed a maintenance operation; issuing a notification notifying a user when it is time to execute a maintenance operation if the measured elapsed time exceeds a prescribed time; determining whether or not the user has issued a command to execute a maintenance operation with the maintaining unit after a notification has been issued; and executing a maintenance operation with the maintaining unit when it is determined that the user has issued a command to execute the maintenance operation.

BRIEF DESCRIPTION OF THE DRAWINGS

Illustrative aspects in accordance with the invention will be described in detail with reference to the following figures wherein:

FIG. 4 is a flowchart illustrating steps in a purge management process executed by a printer unit in the multifunction peripheral device.

DETAILED DESCRIPTION

Figure 1:
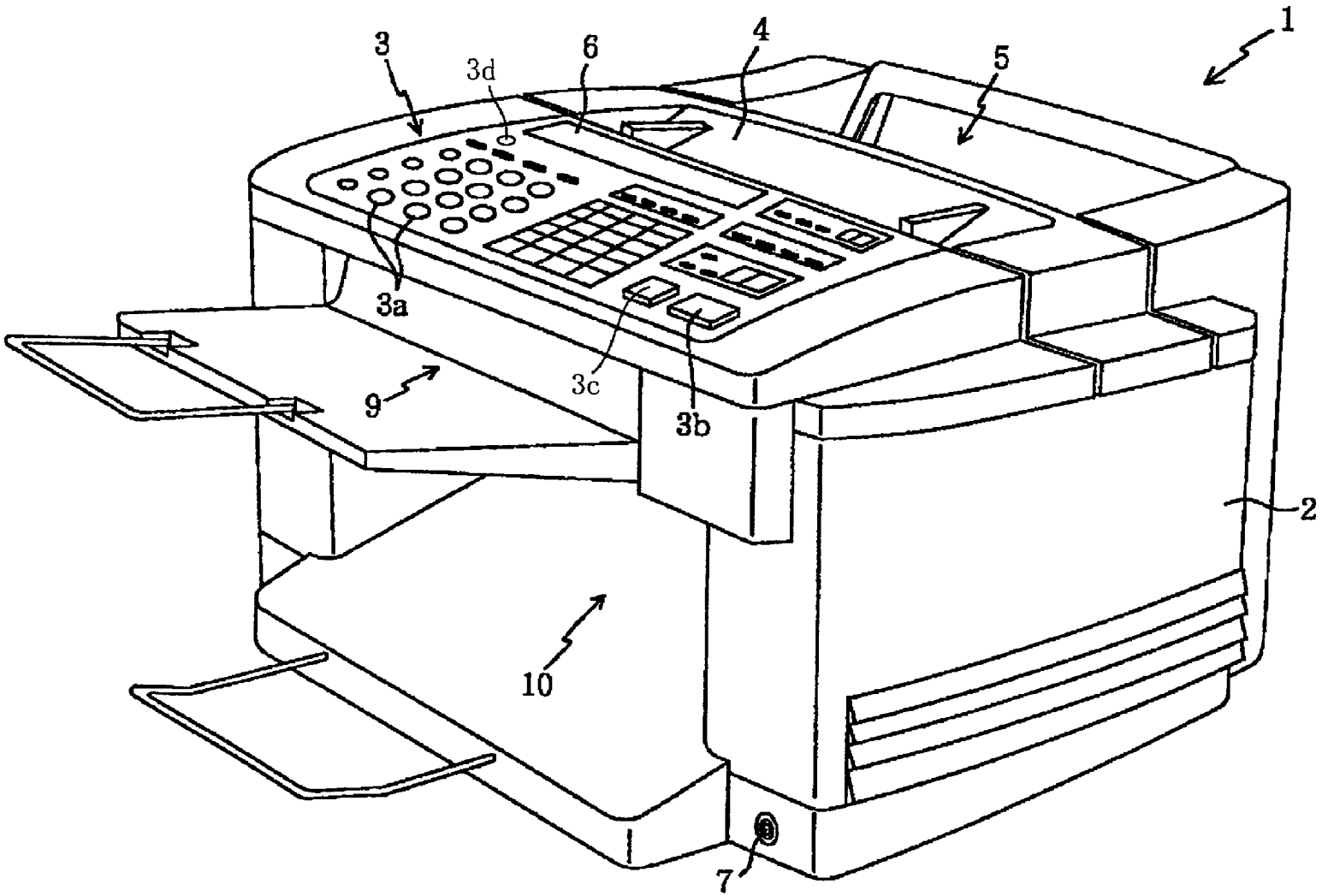
FIG. 1 is a perspective view of a multifunction peripheral device according to one aspect of the invention.

An inkjet printer according to some aspects of the invention will be described while referring to the accompanying drawings wherein like parts and components are designated by the same reference numerals to avoid duplicating description.

FIG. 1 is a perspective view of a multifunction peripheral device 1 according to one aspect of the invention. The multifunction peripheral device 1 includes such functions as a facsimile function, printer function, scanner function, copier function, and video printer function. The multifunction peripheral device 1 is equipped with an inkjet printer 26 (see FIG. 2) with a full-color printing capacity for printing operations performed with these functions.

As shown in FIG. 1, the multifunction peripheral device 1 includes a main body 2 having a box-like shape. A control panel 3 is disposed on the upper front edge of the main body 2. The control panel 3 includes numerical buttons 3*a* for the numbers 0-9, a start button 3*b*, a purge button 3*c*, and various other buttons. The user can implement various operations by pressing these buttons.

By pressing the purge button 3*c*, the user can issue a command to perform a purge process for restoring the ink ejection state of the print head 65 (see FIG. 2) by drawing ink out of the nozzles in the print head 65.

The control panel 3 also includes a purge lamp 3*d*. In a purge management process described later (see FIG. 4), the purge lamp 3*d* lights up when the amount of time that has elapsed since the previous purge process reaches 20 days. Since ink near the nozzle surface of the print head 65 (see FIG. 2) tends to accumulate and dry over the passage of time, the likelihood of ink ejection problems and, therefore, printing complications increases as the amount of time increases since the previous purge process. Hence, if the amount of elapsed time since the previous purge process is longer then or equal to 20 days, the purge lamp 3*d* lights up to notify the user that it is time to execute a purge process. In this way, when the user performs printing operations without executing a purge operation, the user can elect to execute or not execute the purge process after learning that there is potential for printing complications.

A liquid crystal display (LCD) 6 is disposed in the rear portion of the control panel 3 for displaying current settings of the multifunction peripheral device 1, various operating messages, and the like as needed. When the multifunction peripheral device 1 is in a standby state, the current time set via the control panel 3 is displayed on the LCD 6.

An original-supporting part 4 is provided to the rear of the LCD 6 for supporting in a stacked state a facsimile original to be transmitted to another facsimile machine 51 (see FIG. 3) when using the facsimile function or a copy original to be copied when using the copier function. The originals placed on the original-supporting part 4 are conveyed inside the main body 2, where a scanner 19 (see FIG. 3) scans images from the surface of the originals. After the scanning operation, the originals are conveyed further and discharged in a stacked state onto an original discharge unit 9 disposed below the control panel 3.

A cassette insertion part 5 is disposed rearward of the original-supporting part 4. A paper cassette (not shown) capable of accommodating a plurality of sheets of a recording paper P (see FIG. 2) in a stacked state can be detachably mounted in the cassette insertion part 5. The recording paper P is supplied from the paper cassette mounted in the cassette insertion part 5 into the main body 2. After the inkjet printer 26 described later performs a printing operation on the recording paper P, the recording paper P is discharged through a recording paper discharge unit 10 disposed below the original discharge unit 9. A video signal input terminal 7 is disposed adjacent to the right lower portion of the recording paper discharge unit 10. When a video camera or the like is connected to the video signal input terminal 7, a video signal (image data) outputted from the video camera is inputted into the multifunction peripheral device 1 and printed in full color with the inkjet printer 26.

Figure 2:
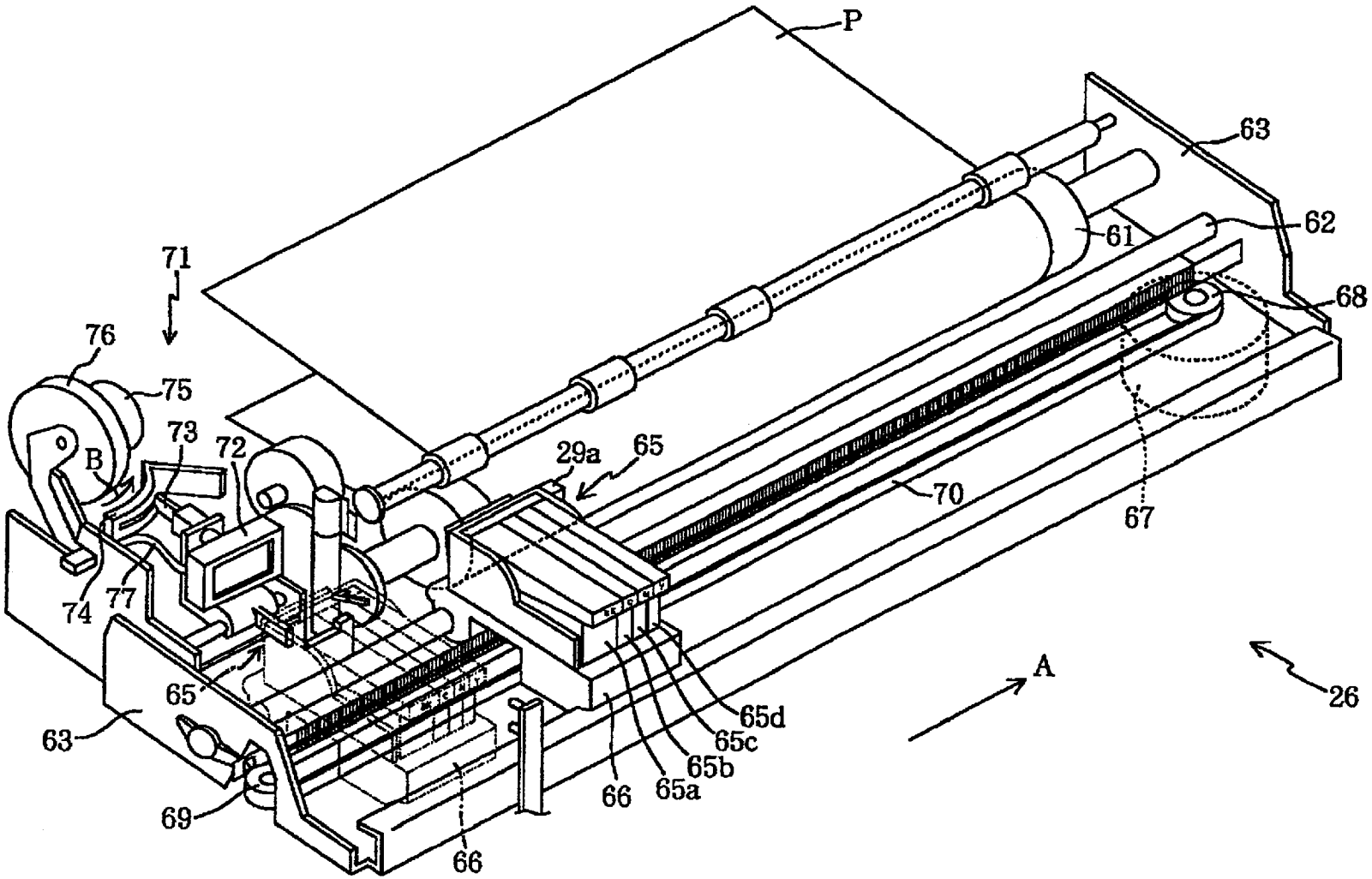
FIG. 2 is a perspective view of an inkjet printer housed within the main body of the multifunction peripheral device.

FIG. 2 is a perspective view of the inkjet printer 26 accommodated in the main body 2 of the multifunction peripheral device 1. The inkjet printer 26 is a serial printer that prints on a recording medium by moving a print head 65 in the direction A indicated in FIG. 2 and the direction opposite the direction A.

The inkjet printer 26 has a frame 63. A platen roller 61 is rotatably mounted in the frame 63 for conveying the recording paper P. A guide rod 62 is fixed to the frame 63 parallel to the platen roller 61. A carriage 66 supporting the print head 65 is supported on the guide rod 62 so as to be capable of moving in a direction orthogonal to the conveying direction of the recording paper P. The carriage 66 is moved over the guide rod 62 parallel to the platen roller 61 by a belt 70. The belt 70 is looped around a drive pulley 68 and a follow pulley 69. A carriage motor 67 is provided on one side of the frame 63 for driving the drive pulley 68 to rotate.

The print head 65 mounted on the carriage 66 includes ink tanks 65*a*-65*d* corresponding to each of four colors. Specifically, the ink tanks 65*a*-65*d*are filled with ink of the colors black, cyan, magenta, and yellow in order from the left side in FIG. 2. Full-color printing is performed on the recording paper P by ejecting ink of these four colors through a plurality of nozzles (ink ejection openings) provided in the print head 65. The ink tanks 65*a*-65*d* can be mounted and detached independently, making it possible to replace only the ink tanks with insufficient ink.

A recovery mechanism 71 for restoring the ink ejection state of the nozzles is disposed on the left side of the frame 63 in FIG. 2. The recovery mechanism 71 includes a suction cap 72 for forming a hermetic seal over all of the nozzles in the print head 65; and a protruding member 73 mounted on the back surface of the suction cap 72 for extending the suction cap 72 in a direction toward the print head 65. One end of the protruding member 73 contacts a surface of a protruding lever 74 that is formed in an arc shape. When the protruding lever 74 moves in the direction B from the state shown in FIG. 2, the suction cap 72 protrudes together with the protruding member 73 toward the print head 65. Accordingly, after the carriage 66 is moved to the position indicated by dotted lines in FIG. 2, the nozzle portion of the print head 65 can be covered by the suction cap 72 and hermetically sealed by moving the protruding lever 74 in the B direction. When the power of the multifunction peripheral device 1 is turned off, the suction cap 72 covers and hermetically seals the nozzle portion of the print head 65, preventing ink in the nozzles from drying out.

The recovery mechanism 71 also includes a cam 76, and a motor 75 for rotating the cam 76 to move the protruding lever 74 in the B direction and the direction opposite the B direction. The rotation of the cam 76 also drives a suction pump (not shown). The suction pump functions to draw out ink via suction tubes 77 connected to the rear surface, or non-suction surface, of the suction cap 72. The suction pump is operated when the suction cap 72 covers the print head 65 in order to draw out ink from nozzles in the print head 65 and restore the ink ejection state of the print head 65.

Figure 3:
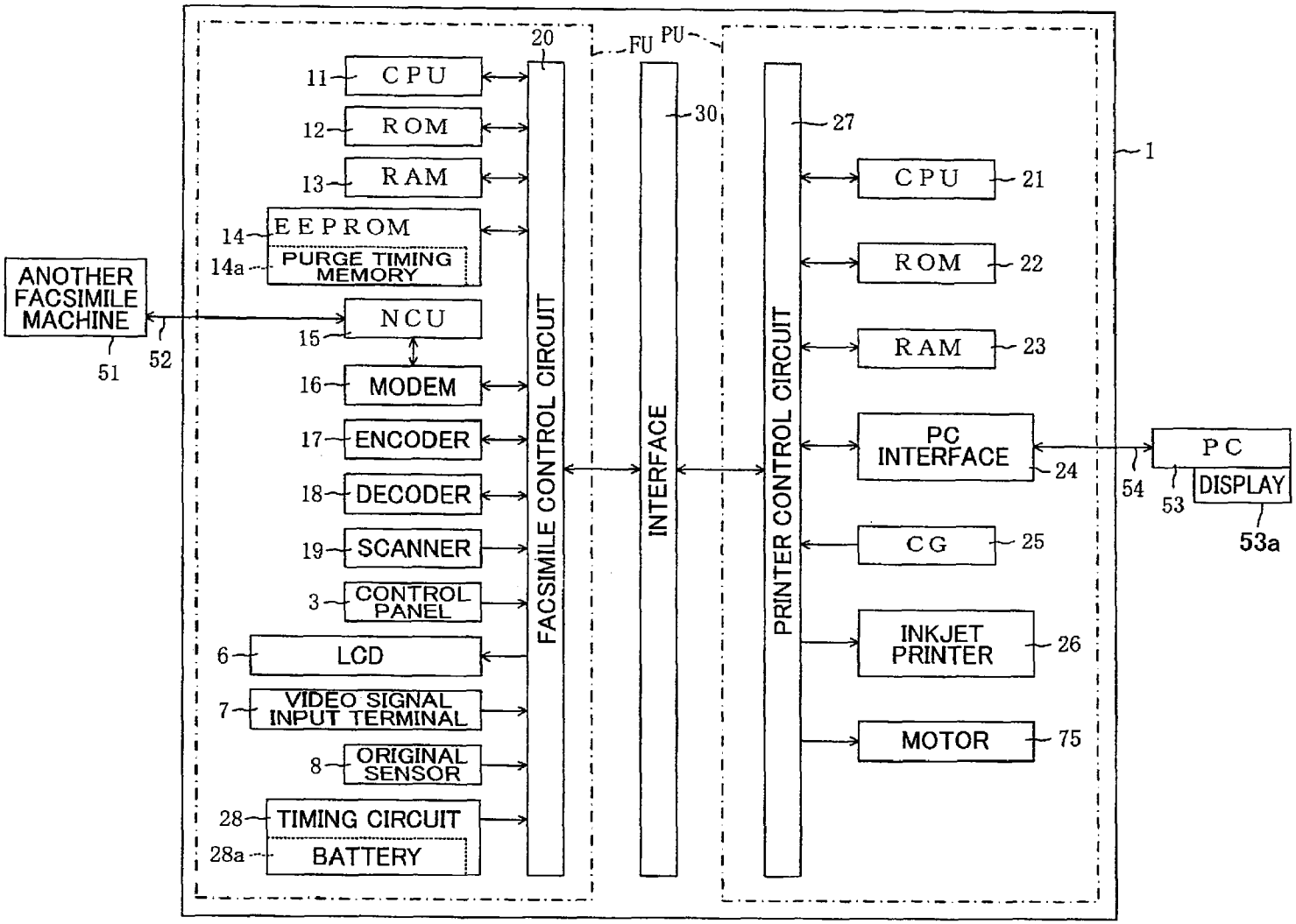
FIG. 3 is a block diagram showing the electrical configuration of the multifunction peripheral device.

FIG. 3 is a block diagram showing the electrical configuration of the multifunction peripheral device 1. The multifunction peripheral device 1 is configured of a facsimile unit FU and a printer unit PU that are connected to each other via an interface 30. The facsimile unit FU includes a CPU 11, a ROM 12, a RAM 13, an EEPROM 14, a network control unit (NCU) 15, a modem 16, an encoder 17, a decoder 18, the scanner 19, the control panel 3, the LCD 6, the video signal input terminal 7, an original sensor 8, and a timing circuit 28, all of which components are connected to each other via a facsimile control circuit 20.

The CPU 11 controls each of the components connected to the facsimile control circuit 20 based on signals exchanged via the NCU 15 for executing a facsimile operation and the like. The ROM 12 is a non-writable memory storing various control programs and the like that are executed on the multifunction peripheral device 1. The RAM 13 is a rewritable memory for temporarily storing various data. The EEPROM 14 is a rewritable, nonvolatile memory. Hence, data stored in the EEPROM 14 can be saved even after the power to the multifunction peripheral device 1 is turned off. The EEPROM 14 includes a purge timing memory 14*a*. The purge timing memory 14*a* stores the time and date of the most recently performed purge process.

The NCU 15 performs operations to transmit a dial signal to a telephone line 52, and to respond to a call signal from the telephone line 52. The modem 16 modulates and demodulates image data and transmits the modulated data to the facsimile machine 51 via the NCU 15 or exchanges procedure signals for controlling transmissions with the facsimile machine 51. The encoder 17 functions to compress image data of an original or the like read by the scanner 19, while the decoder 18 functions to decode encoded data such as received facsimile data. The scanner 19 functions to scan images from originals inserted into the multifunction peripheral device 1 from the original-supporting part 4. The original sensor 8 functions to detect the presence of an original placed on the original-supporting part 4.

The timing circuit 28 is a circuit that keeps track of the current date and time. The timing circuit 28 includes a battery 28*a* for enabling the timing circuit 28 to continue keeping track of the current time after the power to the multifunction peripheral device 1 has been turned off. The user sets the initial current time in the timing circuit 28 through the control panel 3. The current time in the timing circuit 28 is outputted to and displayed on the LCD 6 when the multifunction peripheral device 1 is in a standby state, that is, when operating functions of the multifunction peripheral device 1 have been halted. After a purge process, the printer unit PU reads the current time in the timing circuit 28 and writes this time to the purge timing memory 14*a* of the EEPROM 14.

The facsimile unit FU is connected to the facsimile machine 51 via the NCU 15 and the telephone line 52.

The printer unit PU includes a CPU 21 that functions as a processor; a ROM 22 for storing control programs and the like executed by the CPU 21, including a program for a purge management process shown in the flowchart of FIG. 4; a RAM 23 having various work areas that are referenced and updated by the CPU 21 when the CPU 21 executes control programs, a print memory storing print data, and the like; a PC interface 24 for connecting a host device such as a personal computer 53; a character generator 25 for storing vector fonts of characters and the like being printed; and the inkjet printer 26 described above. The above components are connected to one another via a printer control circuit 27. The PC interface 24 is a parallel interface based on the Centronics standard, for example. The multifunction peripheral device 1 can exchange data with the personal computer 53 via a cable 54 connected to the PC interface 24.

The personal computer 53 includes a display 53*a* for displaying text or images. In the purge management process described later (see FIG. 4), a popup window is displayed in the display 53*a* of the personal computer 53 when a command is received from the multifunction peripheral device 1 indicating that, a purge operation should be executed.

Next, the purge management process executed on the printer unit PU of the multifunction peripheral device 1 having the structure described above will be described with reference to the flowchart in FIG. 4. This process is executed when the power of the multifunction peripheral device 1 is turned on.

In S2 of this purge management process, the multifunction peripheral device 1 (CPU 21) determines whether or not the elapsed time since the previous purge operation is greater than or equal to 20 days based on the current time read from the timing circuit 28 and the previous purge time stored in the purge timing memory 14*a*. If the elapsed time since the previous purge operation is less than 20 days (S2: NO), then the ink ejection state can be considered still satisfactory. Accordingly, the multifunction peripheral device 1 returns to S2 and waits in a loop until the elapsed time reaches 20 days.

When the elapsed time since the previous purge process has reached 20 days (S2: YES), in S4 the multifunction peripheral device 1 transmits a command to the personal computer 53 for displaying on the display 53*a* of the personal computer 53 a popup window including the message "Please perform a purge operation."

Upon receiving the command transmitted from the multifunction peripheral device 1, the personal computer 53 displays the popup window with the message "Please perform a purge operation" on the display 53*a*. Accordingly, when the user is near the personal computer 53, the user can reliably learn that it is time to execute a purge and that printing complications may occur if the purge process is not performed. Accordingly, the user can consider whether or not printing complications are allowable in the current printing operation before issuing a command from the personal computer 53 to the multifunction peripheral device 1 for executing the printing operation. If the printing complications are not acceptable in this case, the user can execute a purge process prior to actually performing the printing operation by walking to the location of the multifunction peripheral device 1 and pressing the purge button 3*c*. Since this method prevents unacceptable printing complications before they occur, the multifunction peripheral device 1 can prevent unnecessary consumption of recording paper and can reduce the user's workload by eliminating such operations as re-executing the printing operation. On the other hand, if the user determines that such printing complications are acceptable after considering the content and usage of the print results, the user can issue a command to execute the printing operation without performing the purge process. In this way, the multifunction peripheral device 1 can reduce the number of times the purge process is executed, reducing ink consumption. The message in the popup window displayed on the display 53*a* of the personal computer 53 may be modified in a variety of ways, provided the message can notify the user that a purge process should be executed. Further, the popup window is displayed continuously until the user closes the window on the personal computer 53.

Next, the multifunction peripheral device 1 determines in S6 whether or not the elapsed time since the previous purge process is greater than or equal to 20 days and 300 hours based on the current time read from the timing circuit 28 and the previous purge time stored in the purge timing memory 14*a*. If the elapsed time is less than 20 days plus 300 hours (S6: NO), then in S8 the multifunction peripheral device 1 determines whether or not the elapsed time since the previous purge process has is greater than or equal to 20 days plus 200 hours. If the elapsed time has not reached 20 days plus 200 hours (S8: NO), then in S10 the multifunction peripheral device 1 determines whether or not the elapsed time since the previous purge process is greater than or equal to 20 days plus 100 hours.

If the elapsed time has not yet reached 20 days plus 100 hours (S10: NO), then in S12 the multifunction peripheral device 1 lights up the purge lamp 3*d* (see Fig, 1). Hence, when the elapsed time since the previous purge process reaches 20 days, then the purge lamp 3*d* is lit to notify the user of the potential for printing complications if a printing process is performed without executing the purge operation.

In S14 the multifunction peripheral device 1 determines whether or not the user has pressed the purge button 3*c*. If the user has pressed the purge button 3*c* (S14: YES), then in S20 the multifunction peripheral device 1 executes a purge process to draw ink from the nozzles in the print head 65 in order to restore the ink ejection state of the print head 65. Thus, the ink ejection state of the print head 65 is restored by positively flowing ink through the nozzles. However, if the user has not pressed the purge button 3*c* (S14: NO), then the multifunction peripheral device 1 returns to S6 without executing the purge process. By turning on the purge lamp 3*d* as described above, the user recognizes the potential for printing complications if the purge process is not, executed. Therefore, the user can elect whether to execute the purge process after determining whether the printing complications are allowable.

After executing the purge process in S20, in S22 the multifunction peripheral device 1 writes the current time from the timing circuit 28 to the purge timing memory 14*a*, updating the previous purge time to the current purge time. Subsequently, the multifunction peripheral device 1 extinguishes the purge lamp 3*d* in S24 and returns to S2.

As long as the user has not pressed the purge button 3*c* (S14: NO), the process from S6 to S14 is repeated. If the elapsed time since the previous purge process is determined to be greater than or equal to 20 days and 100 hours (S10: YES), then in S16 the multifunction peripheral device 1 flashes the purge lamp 3*d* at intervals of 0.5 seconds. If the user still has not issued a command to execute the purge process (S14: NO) and the elapsed time since the previous purge process becomes greater than or equal to 20 days and 200 hours (S8: YES), then in S18 the multifunction peripheral device 1 flashes the purge lamp 3*d* at intervals of 0.2 seconds.

By changing the flashing rate of the purge lamp 3*d* based on the elapsed time since the previous purge process in this way, the multifunction peripheral device 1 can notify the user of the degree of necessity for the purge process. In other words, the longer the elapsed time grows since the previous purge process, the greater the degree of printing complications that can occur by not executing the purge process. By shortening the interval at which the purge lamp 3*d* is flashed as the elapsed time grows longer, the user can visually recognize the degree of printing complications that may occur. If the user determines that printing complications caused by not executing the purge process are allowable after learning the degree of printing complications, the user can elect not to execute the purge process.

If the user still has not issued a command to execute the purge process (S14: NO) and the elapsed time since the previous purge process becomes greater than or equal to 20 days and 300 hours (S6: YES), then in S20 the multifunction peripheral device 1 automatically executes the purge process.

In other words, the multifunction peripheral device 1 automatically executes the purge process without receiving a command from the user if 300 hours has elapsed since the purge lamp 3*d* was turned on, and the user has not issued a command to execute the purge process during this time. In this way, the multifunction peripheral device 1 can prevent damage to the print head 65. For example, it is possible that the user does not execute a purge process over a long period of time due to indifference toward the printing complications, despite the purge lamp 3*d* flashing continuously. In this case, ink deposited on the surface of the ink ejection openings may harden to the point that the ink ejection state cannot be restored with a purge process. If the user continues to use the multifunction peripheral device 1 in this state, the print head may become damaged.

As described above, the multifunction peripheral device 1 notifies the user when it is time to execute a purge process by displaying a popup window on the personal computer 53 or lighting the purge lamp 3*d*, and subsequently executes the purge process when the user issues a command to execute the purge process. In other words, the multifunction peripheral device 1 notifies the user of the potential for printing complications due to not executing the purge process and performs the purge process after the user receives the notification and issued a command to execute the purge process. Accordingly, the user can elect not to perform a purge after learning of the potential for printing complications if the user determines that such complications are allowable, and can execute the purge process prior to a printing operation if the user determines that the printing complications are not allowable. Therefore, the multifunction peripheral device 1 can execute the purge process at a suitable timing, thereby reducing the amount of printing with printing complications of a degree not acceptable to the user. At the same time, the multifunction peripheral device 1 reduces the number of times the purge process is executed and suppresses unintended ink consumption more than a comparative inkjet printer that performs a purge process at regular intervals.

In S4, the multifunction peripheral device 1 transmits a command to the personal computer 53 for displaying on the display 53*a* a popup window including the message "Please perform a purge operation." Therefore, the multifunction peripheral device 1 can notify the user when a maintenance operation must be performed, even when the user is near the personal computer 53 in a remote location from the multifunction peripheral device 1. If the process of S4 were not provided, the user will proceed to the multifunction peripheral device 1 to retrieve the printing results after outputting a print command in the external device 53. After viewing the printing results, the user will have to reprint the data if the results have complications that are not allowable. In this comparative case, the user will have to travel back and forth between the external device 53 and the multifunction peripheral device 1. Further, sheets of the recording medium will be wasted. This problem can be solved by transmitting in S4 a command to the personal computer 53 for displaying a popup window including the message "Please perform a purge operation."

Since the lit state of the purge lamp 3*d* changes according to the amount of elapsed time since the previous purge process, the multifunction peripheral device 1 can notify the user of the degree of necessity for executing a purge. Accordingly, the multifunction peripheral device 1 enables the user to select. whether to execute the purge process after learning the degree of printing complications that can occur if the purge process is not executed, thereby executing the purge process at a more suitable timing.

More specifically, the multifunction peripheral device 1 can notify the user of the degree of necessity for executing the maintenance operation. Ink deposited in the ink ejection openings can lead to ink ejection problems in the print head. The amount of deposition increases as time elapses since the previous maintenance operation. Therefore, the degree of printing complications that may occur when the maintenance operation is not executed increases the more time has elapsed since the previous maintenance operation. By changing the content of notifications according to the amount of elapsed time, the user can determine whether to allow printing complications after learning the degree of the complications that may occur and can elect to execute or not execute the maintenance operation, thereby performing the maintenance operation at a more suitable timing. As a result, the multifunction peripheral device 1 can reduce the number of times the maintenance operation is executed as much as possible and can suppress unintended ink consumption.

While the invention has been described in detail with reference to the above aspects thereof, it would be apparent to those skilled in the art that various changes and modifications may be made therein without departing from the spirit of the invention.

For example, the purge process described above restores the ink ejection state of the print head 65 by drawing ink out of the nozzles in the print head 65. However, the purge process may be modified to restore the ink ejection state of the print head 65 by ejecting ink through the nozzles thereof. The ink ejection state of the print head 65 can be restored by thus positively flowing ink through the nozzles thereof.

In the above description, the multifunction peripheral device 1 lights up or flashes the light source 3*d* provided outside thereof in order to notify the user when it is time to execute a maintenance operation. Instead, the multifunction peripheral device 1 may be provided with a sound source, and may produce a warning sound from the sound source to notify the user that it is time to execute the maintenance operation. Or, the multifunction peripheral device 1 may display text or images on a display unit, such as the LCD 6, provided in the multifunction peripheral device 1 to notify the user that it is time to execute the maintenance operation. The multifunction peripheral device 1 may be modified to employ various methods to output information in the form of light, sound, text, or images, for example, in order to enable the user to recognize by sight or sound that it is time to execute the maintenance operation.

In the above description, the multifunction peripheral device 1 includes the facsimile function, printer function, scanner function, copier function, and video printer function. However, the multifunction peripheral device 1 may be modified to other various types of inkjet printer that perform one or more of the facsimile function, printer function, copier function, and video printer function.

What is claimed is:

1. An inkjet printer comprising:

a print head formed with one or more ink ejection opening for printing a printing medium by ejecting ink through the ink ejection opening;

a maintaining unit that restores the ink ejection state of the print head by flowing ink through the ink ejection opening;

a timing unit that keeps track of an elapsed time after the maintaining unit has executed a maintenance operation;

a notifying unit that issues a notification notifying a user when it is time to execute a maintenance operation if the elapsed time measured by the timing unit exceeds a prescribed time, the notification being postponed until the elapsed time measured by the timing unit exceeds the prescribed time;

a maintenance command determining unit that determines whether or not the user has issued a command to execute a maintenance operation with the maintaining unit after the notifying unit has issued a notification; and a maintenance operation executing unit that executes a maintenance operation with the maintaining unit when the maintenance command determining unit determines that the user has issued a command to execute the maintenance operation.

2. An inkjet printer according to claim 1, wherein the maintaining unit that restores the ink ejection state of the print head by ejecting ink from the ink ejection opening.

3. An inkjet printer according to claim 1, wherein the maintaining unit that restores the ink ejection state of the print head by drawing ink from the ink ejection opening.

4. An ink jet printer according to claim 1, further comprising a connecting unit that is capable of being connected to an external device, the external device being configured to output a print command to execute a printing operation on the inkjet printer and having a displaying unit that displays text or images;

wherein the notifying unit notifies the user when it is time to execute a maintenance operation by transmitting, to the external device, a command to display a notification on the displaying unit of the external device, the notification indicating that a maintenance operation should be executed.

5. An inkjet printer according to claim 1, wherein the notifying unit is capable of issuing a plurality of different notifications that are different from one another based on the amount of elapsed time measured by the timing unit.

6. An inkjet printer according to claim 1, wherein the maintenance operation executing unit executes a maintenance operation with the maintaining unit when another prescribed time greater than the prescribed time has elapsed, even when the user fails to issue a command to execute the maintenance operation after being notified by the notifying unit.

7. An inkjet printer comprising:

a print head formed with one or more ink ejection opening for printing a printing medium by ejecting ink through the ink ejection opening;

a maintaining unit that restores the ink ejection state of the print head by ejecting or drawing ink from the ink ejection opening;

a timing unit that keeps track of an elapsed time after the maintaining unit has executed a maintenance operation;

a notifying unit that issues a notification notifying a user when it is time to execute a maintenance operation if the elapsed time measured by the timing unit exceeds a prescribed time, the notification being postponed until the elapsed time measured by the timing unit exceeds the prescribed time;

a maintenance command determining unit that determines whether or not the user has issued a command to execute a maintenance operation with the maintaining unit after the 5 notifying unit has issued a notification; and a maintenance operation executing unit that executes a maintenance operation with the maintaining unit when the maintenance command determining unit determines that the user has issued a command to execute the maintenance operation.

8. A method of maintaining an ink ejection state of a print head in an inkjet printer, the inkjet printer including the print head formed with one or more ink ejection opening for printing a printing medium by ejecting ink through the ink ejection opening, a maintaining unit that restores the ink ejection state of the print head by flowing ink through the ink ejection opening, the method comprising:

keeping track of an elapsed time after a maintaining unit has executed a maintenance operation;

issuing a notification notifying a user when it is time to execute a maintenance operation if the measured elapsed time exceeds a prescribed time, the notification being postponed until the elapsed time exceeds the prescribed time;

determining whether or not the user has issued a command to execute a maintenance operation with the maintaining unit after a notification has been issued; and executing a maintenance operation with the maintaining unit when it is determined that the user has issued a command to execute the maintenance operation.

9. A method according to claim 8, wherein the notification is changed when the amount of the measured elapsed time reaches another prescribed time that is greater than the prescribed time while the user fails to issue a command to execute a maintenance operation after the notification has been issued.

* * * * *